United States Patent [19]

Widén et al.

[11] 4,444,332

[45] Apr. 24, 1984

[54] CONTAINER AND CLOSURE HAVING INTEGRAL SEALING MEANS

[76] Inventors: Sune Widén, Vallörtsvägen, 352 51 Växjö; Börge Jensen, Linnegatan 22, 340 14 Lagan; Lars Björk, Hulie, 340 14 Lagan, all of Sweden

[21] Appl. No.: 292,939

[22] Filed: Aug. 14, 1981

[30] Foreign Application Priority Data

Aug. 19, 1980 [SE] Sweden ..... 8005819

[51] Int. Cl.[3] ..... B65D 41/16; B65D 41/18

[52] U.S. Cl. ..... 220/306; 215/DIG. 1; 215/321

[58] Field of Search ..... 220/306, 307; 215/DIG. 1, 317, 321, 344

[56] References Cited

U.S. PATENT DOCUMENTS 2,818,204 12/1957 Henchert et al. ..... 215/DIG. 1
3,770,156 11/1973 Yates, Jr. ..... 215/DIG. 1
3,833,141 9/1974 Leitz ..... 215/344
3,881,627 5/1975 Davolt ..... 215/344
4,279,358 7/1981 Jacobs ..... 220/306 X

*Primary Examiner*—George T. Hall
*Attorney, Agent, or Firm*—Holman & Stern

[57] ABSTRACT

In a container structure including a container and a closure member, the container having adjacent its mouth a rim portion provided with sealing surfaces adapted to cooperate with complementary sealing surfaces on the rim portion of the closure member, the improvement comprising one of the sealing surfaces of the rim portions of the container or the closure member including at least two spaced apart annular beads, each of the beads sealingly engaging the walls of a complementary groove formed in the sealing surface of the other rim portion in at least two separate sealing zones, so that positive sealing is accomplished with minimal inclusion of air between the sealing surfaces.

3 Claims, 2 Drawing Figures

CONTAINER AND CLOSURE HAVING INTEGRAL SEALING MEANS

BACKGROUND OF THE INVENTION

1. Field of the Invention

The present invention relates to a container having a closure element, preferably a container consisting of plastic, the container having at its opening an edge portion formed with sealing surfaces which are adapted to cooperate with complementary sealing surfaces of the edge portion of the closure element.

2. Description of the Prior Art

Containers for shipment and storage of different products, such as food products, paint, glue and so on are to an increased extent manufactured from plastic material instead of the previously predominating materials, glass and sheet metal. This is, of course, due to the fact that a plastic container is simple and cheap to manufacture, is strong and has a low weight. In substantially only one respect the glass or sheet metal containers are more advantageous than plastic containers and this is that it is in general easier to provide a tight connection between the closing element and the opening edge of the container in a glass or sheet metal container than in a plastic container. The difficulties in providing a well sealed plastic container is due to the fact that the manufacturing tolerances as well as the dimensional stability are not as good in a plastic container than in a container manufactured from the rigid materials glass and sheet metal.

SUMMARY OF THE INVENTION

The object of the present invention is to provide a container having a closure element in which the sealing surfaces of the container and the closure element are constructed to comply with great demands for tightness in spite of the fact that the container as well as the closure element are manufactured from plastic material.

In order to comply with this object the container according to the invention is characterized in that one of the edge portions of the container or the closure element comprise at least two annular beads, each bead engaging a complementary groove formed in the other edge portion, and that each bead sealingly engages the walls of the complementary groove within at least two separate sealing zones.

In a preferred embodiment of the container according to the invention each side surface of the heads forms an angle with the opposite wall of the complementary groove.

Preferably the beads are formed so that the cross-section thereof tapers in the direction of its free end, the beads having at their base a somewhat greater width than the width of the grooves at the mouth thereof and having at their free end a width somewhat narrower than the width of the grooves at the bottom thereof so that there is provided a sealing engagement between the beads and the walls of the grooves adjacent the mouths of the grooves.

Thus, in a container according to the invention the sealing problems have been solved by the fact that the engagement between container and closure element takes place within a great number of, for example six separate sealing zones. Thereby, a plastic container constructed according to the present invention can also be used in such cases wherein the previously known plastic containers have offered in sufficient tightness.

An example of such a case is a container for paint which is positioned in a shaking machine for stiring the paint when different tints have been added to vary the color. In a plastic container accoding to the instant invention the closure element provides such a complete seal at the edge portion of the container that the container is tight also during such a shaking operation.

An embodiment of the invention is described in the following with reference to the accompanying drawings.

DETAILED DESCRIPTION

Figure 1:
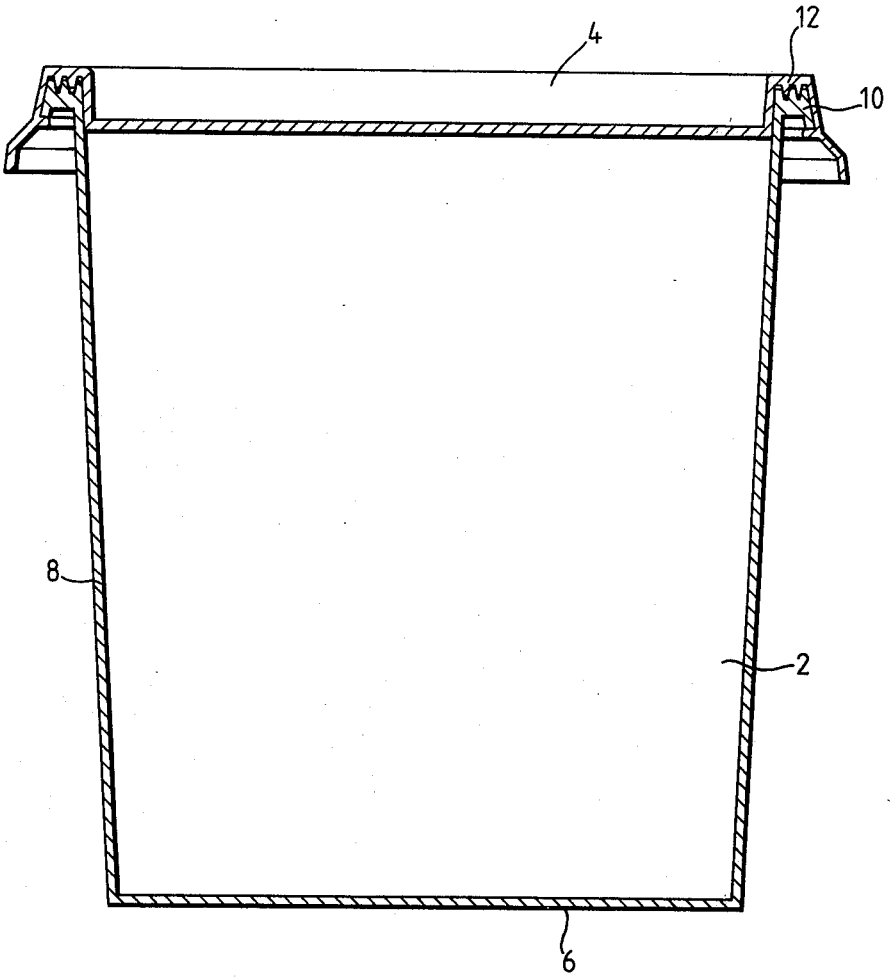
FIG. 1 is a vertical cross-sectional view of a plastic container and a closure element according to the invention.

FIG. 1 shows a container 2 having a closure element 4. The container and the closure element consist of a plastic material, preferably polyethylene.

As in the conventional container, the illustrated container 2 includes a bottom 6 and a somewhat conical side wall 8. The side wall 8 is formed with an edge or peripheral rim portion 10 which is constructed to sealingly engage an edge or rim portion 12 of the closure element 4.

Figure 2:
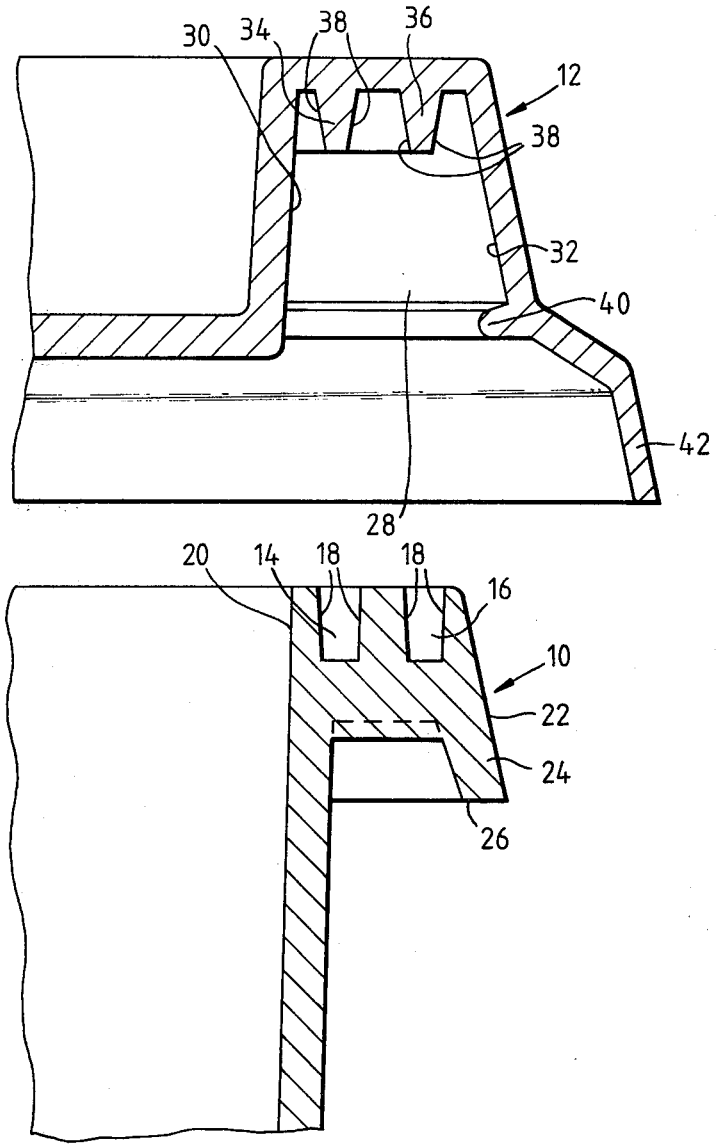
FIG. 2 is a detailed exploded vertical sectional view on an enlarged scale of the edge portions of the container and the closure element according to FIG. 1.

The special construction of the edge portion 10 of the container 2 and the edge portion 12 of the closure element 4 which represents an embodiment of the invention is shown on an enlarged scale in FIG. 2. At its upper surface the edge portion 10 of the container 2 is formed with two annular concentric grooves 14 and 16. The side walls 18 of the grooves are slightly inclined in such a way that the grooves taper inwardly towards the bottom thereof. In the embodiment shown in FIG. 2 the inclination of the side walls 18 is about 2° in relation to the vertical plane. In addition thereto the edge portion 10 forms an inner sealing surface 20 and an outer sealing surface 22. The edge portion 10 also has a downwardly projecting edge on rim flange 24 forming a downwardly facing engagement surface 26.

The edge portion 12 of the closure element 4 is of a generally U-shaped cross-sectional configuration and forms a downwardly open annular recess 28. The recess 28 forms an inner sealing surface 30 and an outer sealing surface 32 and comprises at its bottom two concentric downwardly projecting beads 34 and 36. The side walls 38 of the beads 34 and 36 are inclined in such a way that the beads taper from their bases in the direction of their free ends. In the embodiment shown in FIG. 2, the side surfaces 38 are inclined about 10° in relation to the vertical plane. The base of each bead 34 and 36 has a somewhat greater width than the width of the grooves 14 and 16 at the mouths thereof.

At the lower edge of the outer sealing surface 32 there is provided an inwardly projecting bead 40. The edge portion 12 of the closure element 4 also comprise a downwardly depending edge portion flange 42.

When the closure element 4 is positioned on the container 6 the beads 34 and 36 engage into the grooves 14 and 16, respectively, whereby the beads are not completely received in the grooves as the beads, as mentioned above, have a somewhat greater width at their bases than the width of the grooves at the mouths thereof. Thus, the side surfaces 38 of the beads 34 and 36 will engage the side surfaces 18 of the grooves 14 and 16 adjacent the mouths of the grooves and the bases of the beads. Thereby the beads and the grooves will together form four sealing zones which are separated from each other.

When the edge portion 10 of the container has been received in the edge portion 12 of the closure element and said four sealing zones have been provided between the beads 34 and 36 and the grooves 14 and 16, respectively, there also exists a sealing engagement between the sealing surface 20 of the edge portion 10 and the sealing surface 30 of the edge portion 12 and between the sealing surface 22 of the edge portion 10 and the sealing surface 32 of the edge portion 12.

When the closure element is positioned on the container the bead 40 slides along the outer surface 22 of the edge portion 10 while the portion of the edge portion 12 which supports the bead 40 is biased outwardly until the bead 40 snaps into a position below the downwardly facing engagement surface 26 of the edge flange 24.

Thus, in the position shown in FIG. 1 wherein the closure element 4 is positioned on the container 6 the edge portion 12 of the closure element engages the edge portion 10 of the container within at least six sealing zones which are separated from each other, so that the tightness of the container is maintained under substantially all circumstances.

The removal of the closure element is provided in a simple way by gripping the depending edge portion 42 and pulling outwardly so that the bead 40 is disengaged from the engagement surface 26 and the closure element can be lifted upwardly.

The edge portions of the container and the closure element which have been shown and described are so designed as to include very little air between their surfaces and to reduce the air resistance when positioning the closure element on the container. This is a further substantial advantage of the container according to the invention.

The present invention can be modified within the scope of the following claims. For example the number of beads and corresponding grooves can be greater than two if there is desired an increased number of sealing zones. It is also possible to provide the inclination of the side surfaces of the beads and the side walls of the grooves in a different way than what is shown in the embodiment described above. For example it is possible to form the grooves with a more pronounced taper than the beads whereby the sealing zones will be positioned adjacent the bottom of the grooves instead of at the mouths thereof.

It is, of course, also possible to form the grooves in the edge portion of the closure element and the beads in the edge portion of the container.

What is claimed is:

1. In a container structure including a substantially cylindrically shaped plastic container and closure member therefore wherein the container has adjacent its open end a rim portion provided with sealing means adapted to cooperate with complimentary sealing means on a rim portion of the closure member, the improvement wherein said rim portions comprise radially extending flanges and said sealing means on said closure member comprise said flange on the closure having a substantially inverted U-shaped cross-section with a radially extending base forming inner and outer walls facing each other and tapering outwardly from said base, two annular beads extending downwardly from said base spaced from said walls and each other, the sides of said beads tapering inwardly from said base, two complimentary annular grooves in the upper surface of the container flange having downwardly inwardly tapering sides to receive said beads in sealing engagement therewith, complimentary inner and outer tapering walls on said container flange corresponding to said inner and outer walls on said closure member to be received within said U-shaped cross-section of said closure member flange with said corresponding walls in cooperating sealing engagement, the angle of taper of said sides of said beads with respect to said base of the U being greater than the angle of taper of said sides of said grooves, and the width of each bead at said base being greater than the width of the open end of each respective groove, so that when said closure member is fitted onto said container there are six tightly sealing surfaces therebetween.

2. A container and closure structure as claimed in claim 1 wherein said angle of taper of said sides of said beads and said grooves is substantially 10° and 2° respectively.

3. A container and closure structure as claimed in claim 2 and further comprising a substantially radially inwardly projecting retainer bead extending from said outer wall of said closure member at a distance from said base of the U corresponding to the thickness of said container flange so that when said closure member is fitted onto said container said retainer bead tightly snap-fits under the lower outer peripheral surface of said container flange to retain said closure member on said container.

* * * * *